United States Patent [19]

Masera et al.

[11] Patent Number: 4,996,866

[45] Date of Patent: Mar. 5, 1991

[54] ORIENTABLE BENDING ASSEMBLY

[75] Inventors: Ercole Masera, Roveredo In Piano; Giorgio Del Fabro, Cassacco Fraz.Montegnacco; Marcello Del Fabro, Udine, all of Italy

[73] Assignee: M.E.P. Macchine Elettroniche Piegatrici SpA, Udine, Italy

[21] Appl. No.: 487,301

[22] Filed: Mar. 2, 1990

[30] Foreign Application Priority Data

Mar. 6, 1989 [IT] Italy ..... 83348 A/89

[51] Int. Cl.[5] ..... B21D 9/05

[52] U.S. Cl. ..... 72/387; 72/214; 72/216; 72/218

[58] Field of Search ..... 72/387, 214, 215, 216, 72/217, 219

[56] References Cited

U.S. PATENT DOCUMENTS

| | | | |
|---|---|---|---|
| 2,743,757 | 5/1956 | Terwilliger | 72/219 |
| 3,803,893 | 4/1974 | Peddinghaus et al. | 72/217 |
| 4,571,974 | 2/1986 | Pollhammer et al. | 72/387 |
| 4,890,469 | 1/1990 | Dischler | 72/387 |

FOREIGN PATENT DOCUMENTS

| | | | |
|---|---|---|---|
| 0007329 | 1/1982 | Japan | 72/217 |
| 0196227 | 10/1985 | Japan | 72/217 |

*Primary Examiner*—David Jones

*Attorney, Agent, or Firm*—Antonelli, Terry, Stout & Kraus

[57] ABSTRACT

An orientable bending assembly of a type capable of being temporarily retracted below the upper edge of a work platform (15) of a bending-shaping machine for sections is disclosed. The bending assembly is provided with clockwise and anticlockwise rotation of a bending pin (18) and contrast roll (12). A bending, e.g., disk (11) cooperates with and is supported by an orientable slide block (14) pivoted on an orientation pivot (16) lying in the neighborhood of a plane comprising the axis of the contrast roll (12), this plane being substantially parallel to the axis of the section or sections being bent and shaped.

13 Claims, 1 Drawing Sheet

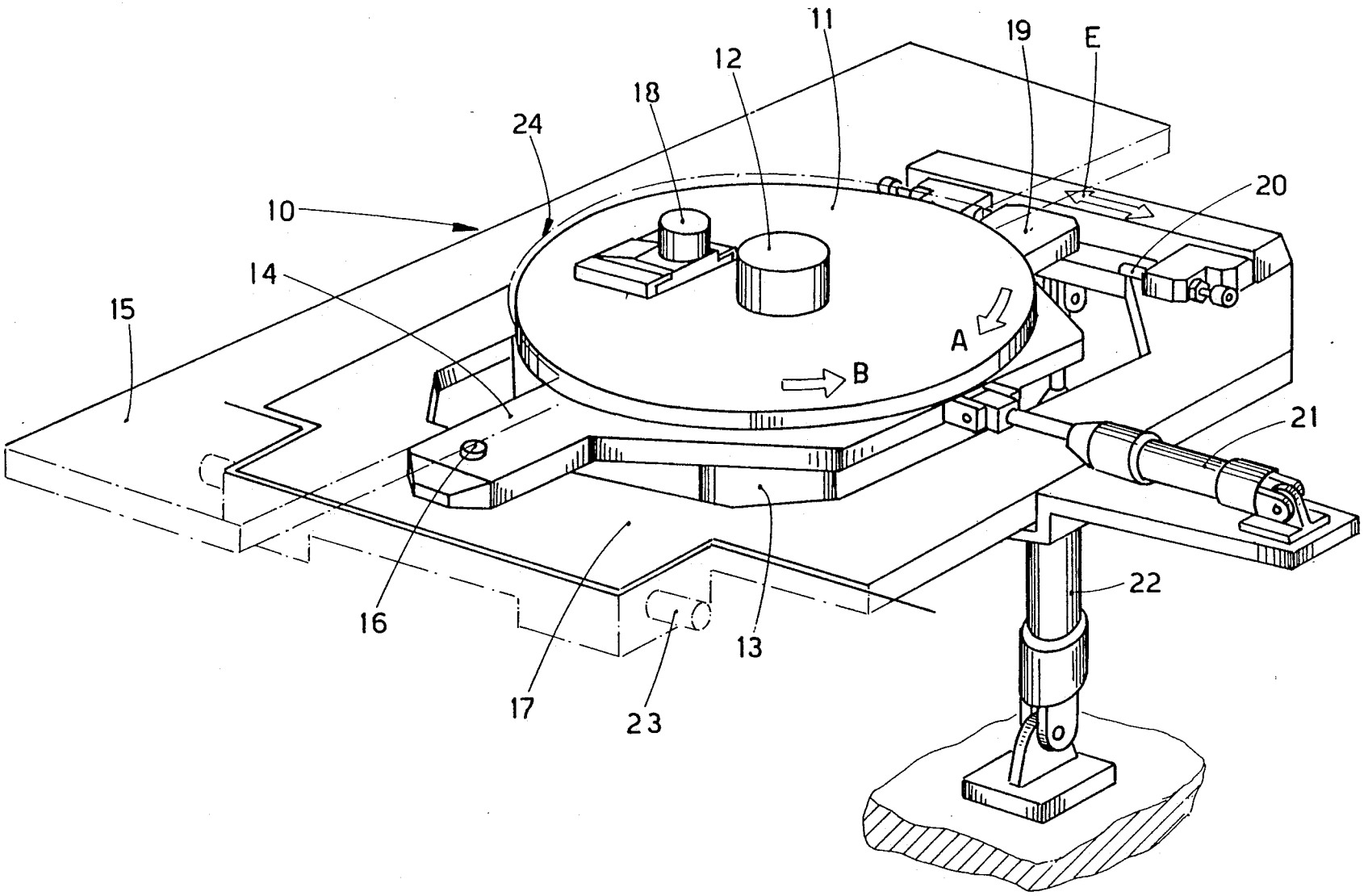
10
11
12
13
14
15
16
17
18
19
20
21
22
23
24
A
B
E

ORIENTABLE BENDING ASSEMBLY

BACKGROUND OF THE INVENTION

This invention concerns an orientable bending assembly. To be more exact, this invention concerns a bending assembly which changes the position of its central bending pin by means of orientation.

The invention is applied properly to machines which bend sections, and is applied advantageously but not only to machines which bend and shape bars for building work.

The invention is also applied to all cases where sections are to be bent by a bending pin, or its equivalent, able to rotate about an axis by a required angular value either clockwise or anticlockwise.

By sections are meant solid or hollow sections produced by rolling, drawing, extrusion or forming.

The invention concerns a bending assembly which may be located upstream or downstream of a shears and/or drawing unit and which serves to bend a section according to a required geometric configuration, which may include bends with a clockwise or anticlockwise development.

Document IT 971194 filed on 24.11.72 discloses a bending assembly which comprises a bending pin able to rotate in both directions and cooperating with stationary cams and possibly with a contrast roll.

The bending assembly can move axially so as to free itself momentarily from the constraint created by a section, whether the section be straight or already shaped.

The bending assembly can also move sideways to enable the constrast roll to change its position in relation to the section to be bent.

The above document provides for a linear displacement of the constrast roll; this linear displacement, although simple, leads to limitations as regards the mass to be displaced and the movement times.

Such problems become even greater when the bending assembly includes a disk actuated independently by a hydraulic motor or other suitable motor means.

The sideways or linear displacement of the support which bears and positions the motor unit and the means supporting and guiding the bending disk and the bending disk itself causes in modern bending machines a great waste of energy, the movement of great masses and movements which are too precise for the masses and speeds involved.

Moreover, the resulting structure is complex, expensive and burdensome as regards maintenance.

SUMMARY OF THE INVENTION

To obviate the above drawbacks, the present applicant has designed, tested and embodied this invention, which provides an orientable bending assembly with a contrast roll, or its equivalent, positioned on the axis of a bending plate or disk.

The orientable bending assembly according to the invention is of a type capable of being temporarily retracted below the upper edge of a work platform. The bending assembly is provided with clockwise and anticlockwise rotation of a bending pin and contrast roll. Bending means, e.g. a bending disk, provided with the bending pin and contrast roll, is supported by an orientable slide block pivoted on an orientation pivot lying in the neighborhood of a plane comprising the axis of the contrast roll, this plane being substantially parallel to the axis of the section or sections being bent and shaped.

According to the invention the bending assembly is orientable in a vertical plane which is coplanar with the plane of the bending movement of the bending assembly.

The invention can be applied to bending assemblies with a bending disk, for instance of the type set forth in the following description, or else to bending assemblies having an arm bearing bending roll.

The lay-out according to the invention arranges that the bending assembly is displaced according to an arc of a circle during the step of changing the positioning of the contrast roll from one side to the other of the section to be bent.

As the contrast roll has to be located substantially at a tangent to the section, stationary or adjustable positioner means can be used for the angular positioning.

If the positioner means that condition the angular position of the bending assembly according to the diameter of the section and to the diameter of the contrast roll are adjustable, the adjustment can be controlled and governed according to an algorithm which takes such parameters into account.

The bending assembly may be positioned in cooperation with shears and possibly also in cooperation with a drawing unit, which may be located upstream or downstream of the bending assembly.

BRIEF DESCRIPTION OF THE DRAWING

The sole FIGURE shows a three-dimensional, partly cutaway diagram of a possible bending assembly according to the invention. In this example the bending assembly is of a type including a rotary disk.

DETAILED DESCRIPTION OF THE PREFERRED EMBODIMENTS

As an example, the invention has been shown combined with a bending assembly of the type disclosed in IT 15902 A/89 of 18.1.89 in the name of the present applicant.

With reference to the embodiment shown as an example of a bending assembly 10, a contrast roll 12 can be replaced readily by being extracted and in this way can be adapted to the various requirements of a section to be bent; thus the diameter of the contrast roll 12 can be changed as desired to suit such requirements.

The contrast roll 12 cooperates with a bending pin 18.

A bending means 11, which in the example shown is a disk means, is set in rotation clockwise (A) or anticlockwise (B) by a motor 13 directly through kinematic motions, which have not been shown as they are not relevant for the understanding of the invention.

The motor 13 may also consist of any system such as, for instance, an electric or hydraulic motor, a cylinder/-piston actuator with a rack or another system suitable for the purpose.

The bending disk 11 is supported on a slide block 14, which can be oriented about a pivot 16 according to the arrow E by the first cylinder/piston actuator 21 or another means suitable for the purpose.

The pivot 16 lies substantially in the neighbourhood of a vertical plane including the axis of the contrast roll 12.

The pivot 16 may be positioned upstream or downstream of the bending disk 11 in relation to the direction of feed of the section or sections.

The bending disk 11 is therefore able to be moved and oriented on the pivot 16 according to an arc of a circle within an opening 24 included in a work platform 15.

The work platform 15 may lie substantially at the same level as the surface of the bending disk 11 or higher or lower.

In the example shown the slide block 14 can be moved for its orientation by an actuation means, which in this case is shown as being the first cylinder/piston actuator 21. Instead of the first actuator 21 there may be included any means suitable to provide sideways movement of the slide block 14; this sideways movement may extend to an end-of-travel abutment or may be of a self-controlled type extending to the required position which the slide block 14 has to reach.

The first actuator 21 may be a cylinder/piston actuator with one piston rod, a cylinder/piston actuator with two opposed coaxial rods in the cylinder, a circular sector cooperating with a gear wheel, a motor acting on the pivot 16, which is therefor an integral part of the slide block 14, or any other means suitable for the purpose.

The slide block 14 may include abutments 19 that cooperate with end-of-travel abutments 20, so that by adjusting the latter 20 it is possible to position the slide block 14 correctly.

Adjustment of the end-of-travel abutments 20 may be carried out periodically by hand or semi-automatically or be carried out automatically with each change of the section to be bent and/or of the contrast roll 12.

An orientation actuator 21 which is self-controlled or controlled by appropriate position monitors may be provided to adjust the angular position of the slide block 14, so that the slide block positions itself or is positioned at the required angular position.

If abutment means 19 are provided on the slide block 14, they will advantageously but not necessarily be located at the other end of the bending disk 11 in relation to the pivot 16.

In the example shown the slide block 14 is borne on a rocker support 17, which can oscillate on gudgeons 23 anchored to the frame of the machine and which is oscillated by a second cylinder/piston actuator 22 in a manner described in IT 15902 A/89.

It is possible to include, instead of the bending disk 11, a bending arm which supports the bending pin 18.

Instead of the rocker support 17 it is possible to arrange that the contrast roll 12 and bending pin 18 can move axially so that during the transient period of replacement they are retracted axially transiently to obviate contact with the sections being bent and shaped.

We claim:

1. An orientable bending assembly of a type capable of being temporarily retracted below an upper edge of a work platform of a bending machine for at least one section having a longitudinally extending axis, comprising, bending means for bending said at least one section and being provided with a bending pin and a contrast roll, said bending pin and contrast roll being provided so as to be rotatable clockwise and anticlockwise;

an orientable slide block pivotable about an axis of an orientation pivot;

wherein said bending means is supported on said orientable slide block such that said axis of said orientation pivot lies near a plane comprising an axis of said contrast roll, said plane being substantially parallel to said longitudinally extending axis of said at least one section being bent, and wherein said contrast roll and orientation pivot are not coaxial.

2. Bending assembly as claimed in claim 1, further comprising a rocker support anchored to said bending machine and means for oscillating said rocker support about an axis parallel to said upper edge of working platform and perpendicular to said longitudinally extending axis of said at least one section.

3. Bending assembly as claimed in claim 1, in which the axis of the orientation pivot in a working position is substantially normal to the work platform.

4. Bending assembly as claimed in claim 1, in which the orientation pivot is located upstream of the bending means.

5. Bending assembly as claimed in claim 1, in which the orientation pivot is located downstream of the bending means.

6. Bending assembly as claimed in claim 1, in which the orientable slide block is can be oriented by an orientation actuator.

7. Bending assembly as claimed in claim 6, in which the orientation actuator acts on the orientable slide block, and said bending assembly further comprises end-of-travel positioner elements to limit the position of said slide block orientable.

8. Bending assembly as claimed in claim 6, in which the orientation actuator acts on the orientation pivot, said orientation pivot being integrally fixed to the orientable slide block, and said bending assembly further comprises end-of-travel positioner abutments to limit the position of said orientable slide block.

9. Bending assembly as claimed in claim 8, which comprises abutment means fixed to said orientable slide block cooperating with the end-of-travel positioner abutments.

10. Bending assembly as claimed in claim 9, in which the end-of-travel positioner abutments are adjustable.

11. Bending assembly as claimed in claim 9, in which the end-of-travel positioner abutments are automatically adjustable based on the diameter of the at least one section and/or by the diameter of the contrast roll (12).

12. Bending assembly as claimed in claim 8, in which the orientation actuator is of a type providing travel up to the position of abutment against the end-of-travel positioner abutments.

13. Bending assembly as claimed in any of claim 6, in which the orientation actuator is of a controlled positioning type.

* * * * *